United States Patent [19]

Hammer

[11] Patent Number: 4,787,775

[45] Date of Patent: Nov. 29, 1988

[54] ARRANGEMENT FOR TRANSMITTING FORCE FROM A SHEET MADE OF POLYMER MATERIAL ONTO A SUPPORTING SURFACE

[75] Inventor: Heiner I. Hammer, Seevetal, Fed. Rep. of Germany

[73] Assignee: Schlegel Lining Technology GmbH, Hamburg, Fed. Rep. of Germany

[21] Appl. No.: 158,100

[22] Filed: Feb. 16, 1988

Related U.S. Application Data

[63] Continuation of Ser. No. 789,634, Oct. 21, 1985.

[51] Int. Cl.[4] ..... E21D 11/38

[52] U.S. Cl. ..... 405/150; 156/71; 52/410; 405/132; 411/377; 411/429

[58] Field of Search ..... 405/150, 151, 152, 153; 24/113 MP; 52/410; 56/71; 411/376, 377, 372, 373, 429, 430, 431

[56] References Cited

U.S. PATENT DOCUMENTS

| | | | |
|---|---|---|---|
| 4,158,251 | 6/1979 | Howell | 24/113 MP |
| 4,373,842 | 2/1983 | Bettini et al. | 411/377 |
| 4,466,758 | 8/1984 | Hinterreiter et al. | 405/150 |
| 4,580,320 | 4/1986 | Takata | 24/113 MP |
| 4,610,120 | 9/1986 | Canavesi et al. | 405/150 X |

FOREIGN PATENT DOCUMENTS

| | | | |
|---|---|---|---|
| 3223330 | 12/1983 | Fed. Rep. of Germany | 405/150 |
| 47-43388 | 11/1972 | Japan | 411/377 |
| 600135 | 6/1978 | Switzerland | 405/150 |
| 645114 | 10/1950 | United Kingdom | 411/376 |

*Primary Examiner*—Dennis L. Taylor
*Attorney, Agent, or Firm*—Cumpston & Shaw

[57] ABSTRACT

An arrangement for transmitting force in a predetermined direction from a sheet of weldable polymer material to a supporting surface, especially for fastening the sheet to the supporting surface. A fastening element anchored in the supporting surface extends through an orifice in the sheet and carries, on the side of the sheet facing away from the surface, a batten which extends parallel to the sheet transversely to the predetermined force direction. The batten is surrounded by an enveloping body which has been applied in molten form and is welded to the sheet.

8 Claims, 2 Drawing Sheets

Figure 1:
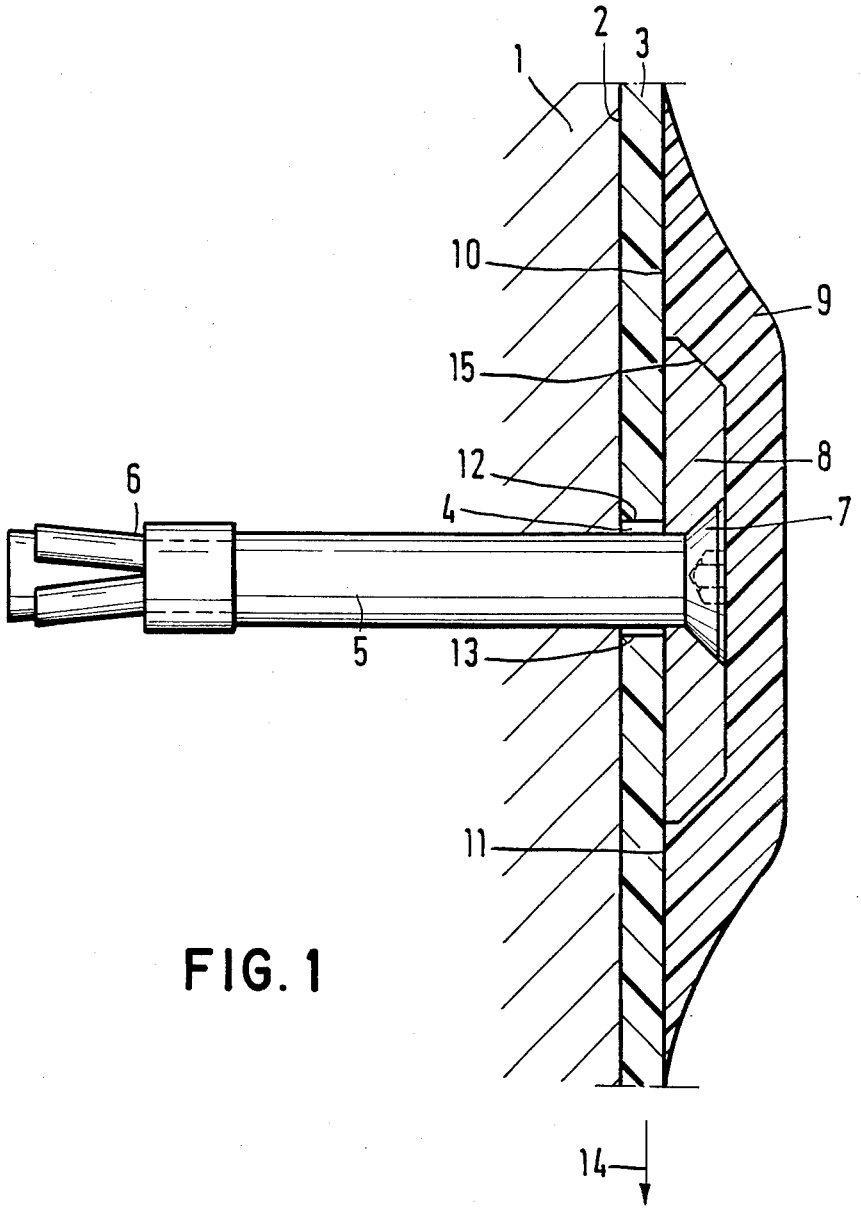

ARRANGEMENT FOR TRANSMITTING FORCE FROM A SHEET MADE OF POLYMER MATERIAL ONTO A SUPPORTING SURFACE

This is a continuation of co-pending application Ser. No. 789,634 filed on Oct. 21, 1985.

DESCRIPTION

The invention relates to apparatus for transmitting force in a predetermined direction from a sheet of weldable polymer material to a supporting surface such as the wall of a tunnel or a canal. A fastening element which is connected firmly to the supporting surface and projects from this, and which extends through an orifice in the sheet carries, on the side of the sheet facing away from the surface, a retaining member interacting with the sheet so as to transmit the force. The invention relates particularly to an arrangement for retaining a sheet against a supporting surface to be sealed off by the sheet, for example in a tunnel lining and to a method for attaching the sheet to the surface.

It is known to anchor bolts in the supporting surface which project through holes in the sheet to be fastened and which are provided with fastening units. The sheet is retained, by direct force transmission from the hole edges to the bolts and by clamping between the nut and the supporting surface. Such a construction is shown in U.S. Pat. No. 3,470,787 which also shows a corrosion preventing protective cap covering the fastener. The result of this arrangement is that the forces to be transmitted are concerned sharply on one point and often exceed the strength of the sheet. When it is desirable to distribute the forces to a greater extent, it is necessary to provide a multiplicity of fasteners of this type, and this is uneconomical. Finally, it is a disadvantage of the known fasteners that the orifices in the sheet, through which the bolt passes, frequently give rise to leaks. It is also known to use battens or rods to distribute forces. However, even when such devices are used, uniform force distribution is not achieved and the forces are greatest in the vicinity of the holes where the nuts exert the greatest force against both the battens and the sheet.

It is an object of the invention to provide more effective and leak-proof force transmission between the sheet and the supporting surface.

In accordance with a presently preferred embodiment of the invention, the retaining member used is an elongated member or batten which extends parallel to the sheet and transversely to the intended force direction and which is wholly or partially enveloped in a body of polymer material applied in molten form and welded to the sheet, so that at least a substantial proportion of the force to be transmitted from the sheet to the supporting surface is transmitted from the sheet via the bond to the enveloping body, from this to the batten and from the latter via the fastening element to the supporting surface and not from the sheet directly to the surface. Preferably the edges of the batten are chamfered or rounded to reduce stress concentration in the enveloping body that would otherwise develop in the region of sharp corners.

The invention provides the possibility of giving the surfaces involved in force transmission any dimensions, largely irrespective of the number of fastening elements passing through the sheet. The distance between these fastening elements can be relatively large; the length of the batten located between them and consequently the length available for force transmission are also just as large. The width of the surface available on the batten (measured transversely to the sheet plane and transversely to the force direction) can be of any size, so that there need be no fear of any local overloads. Force is not transmitted directly from the batten to the sheet, but to the enveloping body which, because it is applied in molten form, matches the surface of the batten perfectly and therefore possesses the best possible preconditions for uniform force transmission. The form and material of this enveloping body can be the best possible choice as regards force transmission. In contrast, the fastening function is not controlling when the material and thickness of the sheet are selected. It is merely necessary for it to be possible to weld the sheet material and the enveloping body to one another when the enveloping body is applied in molten form to the sheet and the batten. Local overloads of the sheet can easily be avoided because the welded interface between the sheet and the enveloping body, where force transmission take place, can be of any size.

The batten preferably has an elongate cross-section, the longer axis of which lies in the predetermined force direction. As a result, the moment of resistance which determines the bending resistance of the barten under the force to be absorbed by it is increased compared to an element such as a washer with a nonelongate cross-section, or with an elongate cross-section the shorter axis of which lies in the predetermined force direction.

When a sheet on which forces can be exerted in different directions is to be fastened, it can be expedient to provide several battens oriented in different direction which are distributed over the sheet surface, for example in the manner of a grid. When, for example, a sheet is used for the leak-proof lining of a tunnel wall, a plurality of fastening battens can be arranged on the sheet in the longitudinal direction of the tunnel, whilst a further plurality of battens runs in the peripheral direction.

In contrast to the known arrangement, in which a nut located on a bolt presses the sheet against the supporting surface, if appropriate via a pressure plate, and thereby secures it, where the invention is concerned it is not essential that the side of the batten facing the supporting surface rest against the sheet. Nevertheless, this can be expedient even where the invention is concerned, so that the lines of action of the forces taking effect in the sheet pass as close as possible to that region where the forces are transmitted from the enveloping body to the batten. A particularly preferred embodiment of the invention is therefore defined in that the sheet rests against the side of the batten facing the supporting surface, and the enveloping body envelopes the batten essentially only on the other three sides.

To guarantee reliable force transmission from the enveloping body to the sheet, the length of the welding surface between the enveloping body and the sheet (in the direction transverse to the longitudinal direction of the batten) will preferably be several times greater than that sheet thickness. In order to fasten an extensive homogeneous sheet surface, larger numbers of battens according to the invention can be distributed more or less uniformly over the area of the sheet. In particular, one or more of the fastening arrangements according to the invention are also to be provided at the edge of the sheet piece, for example at the connecting joint between two adjacent sheet pieces. The term connecting joints must be interpreted broadly in this respect; it embraces not only those arrangement in which the edges of the adjacent sheets are placed next to one another in the manner of a butt joint, but also overlapping arrangements. In this case, the arrangement according to the invention is disposed so that the batten extends over the joint between two adjacent sheet pieces in their longitudinal direction, and the enveloping body is welded to one sheet piece on one side of the batten and to the other sheet piece on the other side of the batten.

To guarantee leak-proofing even where the fastening element passes through the sheets, it is preferred that the enveloping body completely envelops the batten and the fastening element on the side of the sheets facing away from the supporting surface and is also welded completely to the sheet round the fastening element.

Figure 2:
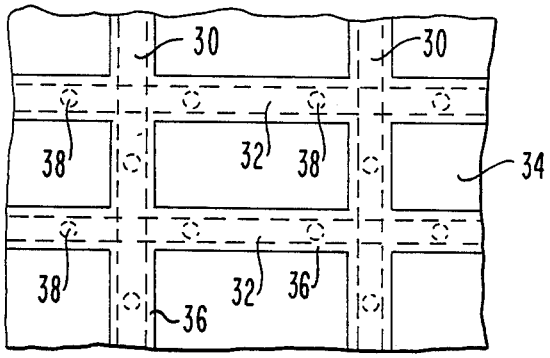
Figure 3:
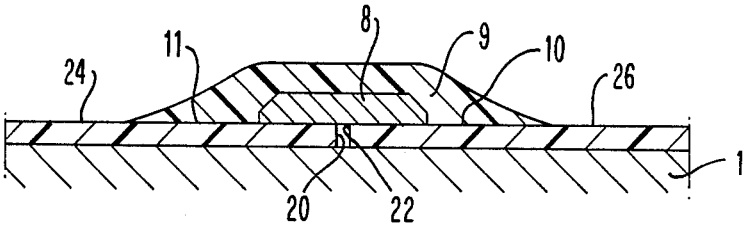
Figure 4:
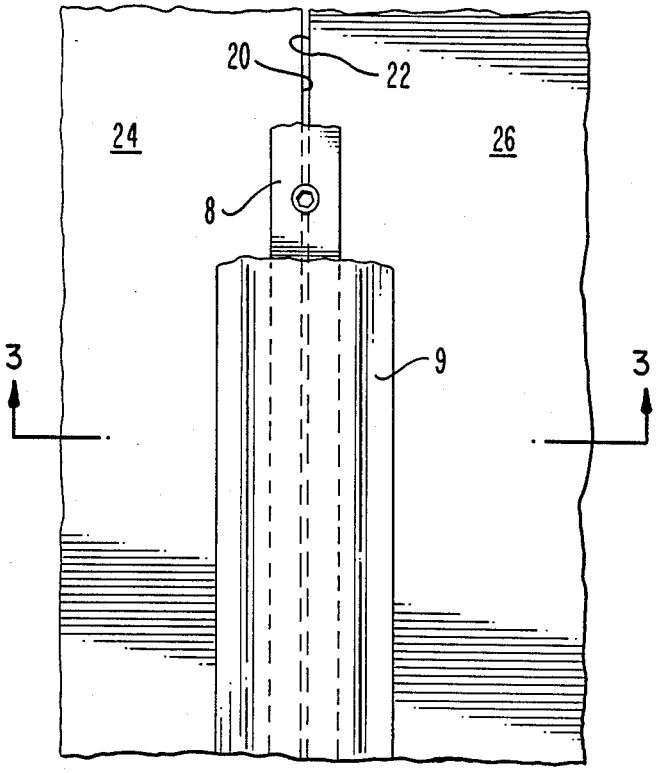

While the novel aspects of the invention are set forth with particularity in the appended claims, the invention itself, together with further objects and advantages thereof may be more readily understood by reference to the following detailed description of the invention, taken in connection with the accompanying drawings in which:

FIG. 1 shows a cross-section of an arrangement in accordance with a preferred embodiment of this invention;

FIG. 2 shown a plan view of a plurality of supporting elements arranged in a matrix in accordance with another embodiment of this invention;

FIG. 3 shows a sectional view of the embodiment of this invention shown in FIG. 4 spanning a joint between two adjacent sheets of lining material; and FIG. 4 shows a plan view of the embodiment of FIG. 3.

Referring now to FIG. 1, the body 1 shown hatched, for example a tunnel wall, forms a supporting surface 2 which is lined with a sheet or panel 3 made of polyethylene or another weldable polymer material. A screw bolt 5 extends through an orifice 4 in the sheet and is anchored in the body 1 by means of a suitable dowel 6. Its head 7 holds a flat iron bar 8 preferably having rounded or chamfered edges functioning as a batten. This can press the sheets 3 against the surface 2, and this is usually expedient to simplify the fastening process, but is not necessary for increasing the holding strength. The flat iron bar 8 extends with its longitudinal direction transverse to the drawing plane. The longer axis of its cross-sectional form is parallel to the sheet 3 in that direction in which tensile forces can be exerted on the fastening arrangement from the sheet.

The bar 8 is completely enveloped in the enveloping body 9 on all sides not covered by the sheet 3 and is welded over its entire area to the sheet 3 in the region of the surfaces 10 and 11. The size of these surfaces 10 and 11 can be selected so that the forces to be expected in the sheet can easily be transmitted to the enveloping body 9, without the possibility of overloading of the sheet in the transmission surfaces 10, 11.

The thickness of the enveloping body 9 in cross-section and the hardness and strength of its material can easily be calculated so that it can transmit the anticipated forces to the bar 8 without detrimental deformation.

The procedure for producing the arrangement is that the sheet 3 is first fixed temporarily to the surface 2 by any means, and then one or more bars 8 are fastened to it by means of screws 5 at suitable screw intervals. This produces a sheet fastening which can generally withstand at once the forces which arise during further assembly. This is therefore an important factor, because the opportunity is thereby provided, during assembly, intitially to fasten larger sheet sections temporarily by means of the bars 8 and the screws 5, before the enveloping body 9 is applied.

The latter is subsequently applied by means of an extruder possessing a die, from which the material of the enveloping body emerges in molten form. The material is applied in such a way that the desired cross-section of the enveloping body, for example of the type shown in the drawing, is obtained, and the desired bonding with the sheet 3 also takes place to a sufficient extent. To improve the welding quality, the welding regions of the sheet 3 can be preheated beforehand to near its welding temperature.

Apparatus for extrusion welding is described in U.S. Pat. No. 4,289,552. Such apparatus may be modified in accordance with this invention to render it more suitable for welding on vertical surfaces or on the underside of horizontal surfaces. For example, the extrusion head may be made detachable. Also it is oftentimes desirable to temporarily attach guide rails to the supporting surface to guide and support the welder. Such rails may be conveniently attached by bolting to the surface through the sheet. The mounting holes through the sheet may be subsequently repaired by spot welding.

If the sheet 3 consists of polyethylene, the enveloping body 9 is also appropriately made of polyethylene. Although it is often expedient for the material of the sheet to conform to that of the enveloping body, this is not a precondition for the invention, provided only that the materials can be welded to one another or allow a connection similar to a welded joint.

The arrangement illustrated can be imagined both within a central region of an undivided sheet surface and in the region of a butt joint between two sheets as shown in FIGS. 3 and 4.

In the latter case, the edges 20 and 22 of the two sheets 24 and 26 are disposed adjacent to one another with the bar 8 extending in its longitudinal direction over the length of the joint formed between the two edges. The enveloping body 9 is joined to one of the two sheets at 10 and to the other of the two sheets at 11. When a holding force is exerted by the lower sheet in the direction of the arrow 14 (the predetermined force direction), this holding force is first transmitted via the weld 11 to the enveloping body 9 and from this in the region 15 to the bar 8 which in turn transfers this force to the bolt 5.

In accordance with a further embodiment of this invention, as illustrated in FIG. 2, an array of bars 30 and 32 is arranged in the manner of a grid over the surface of one or more sheets 34. Each of the bars in the array is enveloped by an enveloping body 36, only two of which are numbered for clarity. The bars are anchored to the surface by a plurality of bolts 38, of which, again for simplicity, only exemplary bolts are designated by reference numerals in the figures.

The precise manner in which the bolts, bars and enveloping bodies are arranged on the sheet, is as shown in either of FIGS. 1 and 3.

What is claimed is:

1. Apparatus for supporting a sheet of weldable polymer material on a supporting surface comprising:

a plurality of fastening elements extending through a plurality of openings in the sheet of weldable polymer material, each of said fastening elements having a first portion connected firmly with respect to the supporting surface, and a second portion extending beyond the sheet;

an elongated rod carried by the second portion of at least two of said fastening elements and extending parallel to the surface of the sheet; and a body of polymer material welded to the sheet along a welding surface and enveloping the rod for transmitting force from the sheet to the rod for supporting the sheet on the surface by force transmitted by the fastening members.

2. An arrangement as claimed in claim 1, wherein the rod (8) has an elongate cross-section with the longitudinal direction lying in the predetermined direction.

3. An arrangement as claimed in claim 1, comprising a plurality of non-parallel rods.

4. An arrangement as claimed in claim 3, wherein the rods are distributed over the sheet surface in the manner of a grid.

5. An arrangement as claimed in claim 1, wherein the sheet (3) rests against the side of the rod facing the supporting surface, and the enveloping body envelops the rod essentially only on the other three sides.

6. An arrangement as claimed in claim 1, wherein the length of the welding surface between the enveloping body and the sheet in the direction transverse to the longitudinal section of the rod is several times greater than the sheet thickness.

7. An arrangement as claimed in claim 1, wherein the rod extends over a joint between two adjacent sheet pieces, and the enveloping body is welded to one sheet piece on one side of the rod and to the other sheet piece on the other side of the rod.

8. An arrangement as claimed in claim 1, wherein the enveloping body completely envelops the rod and the fastening element on the side of the sheet facing away from the supporting surface.

* * * * *